US006010189A

United States Patent [19]

Hybarger et al.

[11] Patent Number: 6,010,189

[45] Date of Patent: Jan. 4, 2000

[54] SYNCHRONIZED CHAIR SEAT AND BACKREST TILT CONTROL MECHANISM

[75] Inventors: Kenneth C. Hybarger, Belding; Philip E. Crossman, Grand Rapids; Bryan H. Zeeuw; LeRoy B. Johnson, both of Lowell; David A. Young, Grand Rapids, all of Mich.

[73] Assignee: Leggett & Platt, Incorporated, Carthage, Mo.

[21] Appl. No.: 09/285,151

[22] Filed: Apr. 1, 1999

Related U.S. Application Data

[62] Division of application No. 09/038,242, Mar. 11, 1998

[60] Provisional application No. 60/040,436, Mar. 12, 1997.

[51] Int. Cl.[7] ..... A47C 3/00

[52] U.S. Cl. ..... 297/300.8; 297/300.7; 297/300.6

[58] Field of Search ..... 297/300.8, 300.7, 297/300.6, 300.2, 300.1, 302.7, 301.7, 302.4

[56] References Cited

U.S. PATENT DOCUMENTS

| | | | |
|---|---|---|---|
| 3,434,756 | 3/1969 | Walkinshaw . | |
| 3,602,537 | 8/1971 | Kerstholt . | |
| 4,384,741 | 5/1983 | Flum et al. | 297/300.8 X |
| 4,555,085 | 11/1985 | Bauer et al. . | |
| 4,626,029 | 12/1986 | Brauning . | |
| 4,664,445 | 5/1987 | Groseth . | |
| 4,709,961 | 12/1987 | Hill | 297/284.11 |
| 4,718,726 | 1/1988 | Estkowski et al. . | |

(List continued on next page.)

FOREIGN PATENT DOCUMENTS

| | | | |
|---|---|---|---|
| 2045120 | 2/1971 | France | 297/300.4 |
| 2044607 | 10/1980 | United Kingdom . | |

*Primary Examiner*—Peter M. Cuomo
*Assistant Examiner*—David E. Allred
*Attorney, Agent, or Firm*—Shook, Hardy & Bacon LLP

[57] ABSTRACT

A chair control mechanism is provided for use on a chair having a separate seat 14 and backrest 16 that move with respect to a base 12 of the chair. The mechanism 22 includes a housing 26 supported on the base, and brackets 28, 30 secured to the seat and backrest. The seat bracket 28 is supported on the housing for pivotal movement about a horizontally extending front pivot axis 68 between an upright position and a reclining position, and the front pivot axis is located adjacent the front end of the housing. The backrest bracket 30 is supported on the housing for pivotal movement about a horizontally extending rear pivot axis 80 that is located rearward of the front pivot axis. A mechanical linkage 70, 78 is connected between the brackets at a position spaced rearward of the rear pivot axis relative to the housing for transmitting pivoting movement between the brackets, and a spring assembly 32 is connected between the housing and the backrest bracket for biasing the seat and backrest toward the upright position. A forward travel-stop control assembly 38 is provided on the mechanism for adjusting the forward most position of the seat and backrest, as is a tilt control assembly 36 which permits the seat and backrest to be locked against tilting movement. The tilt control assembly 36 includes a locking plate 102 supported on the housing for relative translational movement between an extended position in which the locking plate is received in an aperture of the backrest bracket to lock the backrest bracket from further pivotal movement, and a retracted position removed from the aperture to allow further pivotal movement of the seat and backrest. A locking pawl 106 is supported on a lever 104 of the tilt assembly and engages the lock plate 102 to retract and extend the plate when the lever is rotated. In addition, a clutch is interposed between the actuating lever and the locking pawl for exerting a rotating force on the locking pawl to move the locking pawl from the second position when the actuating lever is rotated. The rotating force of the clutch is smaller than the friction force that is exerted on the locking plate when the pivoting force of the spring assembly 32 is exerted on the locking plate such that the locking plate can only be retracted when the friction force is reduced to a magnitude less than the rotating force.

3 Claims, 4 Drawing Sheets

U.S. PATENT DOCUMENTS 4,763,950 8/1988 Tobler .
4,865,384 9/1989 Desanta ..... 297/300.7 X
4,877,290 10/1989 Schetl .
4,892,354 1/1990 Estkowski et al. .
4,906,045 3/1990 Hofman .
4,909,472 3/1990 Piretti .
4,915,449 4/1990 Piretti .
4,979,778 12/1990 Shields .
5,018,787 5/1991 Estkowski et al. .
5,029,940 7/1991 Golynsky et al. .
5,050,931 9/1991 Knoblock .
5,066,069 11/1991 DeGelder .
5,114,211 5/1992 Desanta .
5,160,184 11/1992 Faiks et al. .
5,203,853 4/1993 Caruso .
5,207,479 5/1993 Wickman et al. .
5,282,670 2/1994 Karsten et al. .
5,286,088 2/1994 Taylor et al. .
5,320,410 6/1994 Faiks et al. .
5,333,368 8/1994 Kriener et al. .
5,348,371 9/1994 Miotto .
5,366,274 11/1994 Roericht et al. .
5,370,445 12/1994 Golynsky .
5,385,388 1/1995 Faiks et al. .
5,393,125 2/1995 Watson et al. .
5,417,473 5/1995 Brauning .
5,417,474 5/1995 Golynsky .
5,423,594 6/1995 Hancock et al. .
5,564,783 10/1996 Elzenbeck et al. .
5,567,012 10/1996 Knoblock .
5,577,807 11/1996 Hodge et al. .
5,584,533 12/1996 Schrewe .
5,601,337 2/1997 Choda et al. .
5,630,647 5/1997 Heidmann et al. .
5,630,649 5/1997 Heidmann et al. .
5,630,650 5/1997 Peterson et al. .
5,658,045 8/1997 Van Koolwijk et al. .
5,662,381 9/1997 Roossien et al. .
5,683,139 11/1997 Golynsky et al. .
5,685,607 11/1997 Hirschmann .
5,685,609 11/1997 Miotto .
5,782,536 7/1998 Heidmann et al. ..... 297/300.2 X
5,810,439 9/1998 Roslund, Jr. ..... 297/300.2 X
5,826,940 10/1998 Hodgdon .
5,873,634 2/1999 Heidmann et al. .

SYNCHRONIZED CHAIR SEAT AND BACKREST TILT CONTROL MECHANISM

CROSS-REFERENCE TO RELATED APPLICATIONS

The present application is a divisional application of U.S. Ser. No. 09/038,242, filed Mar. 11, 1998, which is related to and claims priority of Provisional Application No. 60/040,436, filed Mar. 12, 1997.

STATEMENT REGARDING FEDERALLY SPONSORED RESEARCH OR DEVELOPMENT

"Not Applicable"

BACKGROUND OF THE INVENTION

This invention relates generally to chair control mechanisms, and more particularly to a mechanism that synchronizes the movement of a chair seat and backrest in addition to providing independently operable height, tilt and forward travel-stop control assemblies.

It is known to provide a chair having a seat and backrest that are supported on a base independent of one another such that each can be pivoted about a different pivot axis to accommodate a person reclining in the chair. However, because the point about which the user bends is spaced from the pivot axes of the seat and backrest, sliding contact develops between the user and the seat or backrest during tilting of the chair.

The relationship between the path of travel followed by the seat and backrest during tilting is dictated in part by the placement of the pivot axes of the seat and backrest, and in part by the manner in which the seat and backrest are linked to one another. By adjusting these parameters, it is possible to synchronize the seat and backrest movement to maximize the ergonomics of the chair. In some conventional mechanisms, a condition known as bridging occurs, wherein the backrest rotates upwardly and rearwardly from the seat during tilting. This condition is uncomfortable and has a tendency to untuck the shirt or blouse of the user during tilting.

Alternatively, some chairs are subject to fall-away, wherein the backrest rotates downwardly and rearwardly from the seat, reducing lumbar support upon tilting. Yet other chairs may experience crunching, wherein the backrest rotates forwardly and into the seat, pinching the user. Still, other chairs may suffer from pushing, wherein the backrest rotates upwardly and forwardly of the rear of the seat during forward or return tilting movement, again pulling at the clothing of the user. Other prior art chairs may suffer from various combinations of bridging, fall-away, crunching, and pushing.

In chairs having the ability to tilt between upright and reclined positions, it is conventional to provide a tilt control assembly that permits the seat and backrest to be locked in a selected position. Typically, such assemblies include a lever on the mechanism housing that engages the seat or backrest support bracket of the mechanism in the locked position, blocking the support bracket from tilting in either direction. A problem associated with this type of prior art assembly occurs when the user is leaning forward in the chair, e.g. while in a tasking position such as using a keyboard at a computer, and the lever is inadvertently released. When this situation arises, the seat and backrest spring forward toward the upright position under the bias of a spring assembly typically provided on such mechanisms, potentially bumping the user from the chair. As such, "anti-launching" mechanisms are sometimes included on chair control mechanisms to reduce or eliminate such occurrences. These mechanisms must work in conjunction with the tilt control assembly to allow unlocking of the seat and backrest only when the user is seated against the backrest.

BRIEF SUMMARY OF THE INVENTION

It is an object of the present invention to provide a chair seat and backrest tilt control mechanism that synchronizes movement of the seat and backrest to achieve the greatest ergonomic effect and comfort, and that includes a tilt control assembly that will not allow the seat and backrest to be unlocked for movement while a forward pivoting force is exerted thereon.

In addition, it is an object of the invention to provide a chair control mechanism that includes a forward travel-stop control assembly that permits the forward most position of the seat and backrest to be manually adjusted from the chair through the provision of a readily accessible lever supported beneath the seat.

In accordance with these and other objects evident from the following description of a preferred embodiment of the invention, a chair control mechanism is provided for use on a chair having a base on which a seat and backrest are supported. The mechanism includes a housing supported on the base and presenting opposed front and rear ends, and a seat bracket supported on the housing for pivotal movement about a horizontally extending front pivot axis between an upright position and a reclining position. The front pivot axis is located adjacent the front end of the housing to provide a "knee-pivot" tilting action in the seat. The backrest is supported on a backrest bracket that is connected to the housing for pivotal movement about a horizontally extending rear pivot axis between an upright position and a reclining position, wherein the rear pivot axis is located rearward of the front pivot axis relative to the housing. A mechanical linkage is connected between the brackets at a position spaced rearward of the rear pivot axis relative to the housing for transmitting pivoting movement between the brackets, and the brackets are biased toward the upright position by a spring assembly connected between the housing and the backrest bracket.

By providing a control mechanism in accordance with the present invention, numerous advantages are realized. For example, by positioning the pivot axis of the seat bracket as far forward and as low as possible on the housing, a knee tilt arrangement results which allows a user to recline in the chair without a lifting pressure being applied against the undersides of his or her legs by the front edge of the seat. Rather, the seat pivots rearward at such an angle that the height of the front edge of the seat remains substantially fixed. Likewise, by providing a backrest bracket that pivots about an axis above and to the rear of the pivot axis of the seat, an arrangement results in which the movement of the backrest closely matches the movement of the user's back when the seat is reclined. Thus, the chair is comfortable to operate and does not push or pull at the user during tilting movement.

In accordance with another aspect of the invention, the chair control mechanism includes a travel stop positionable between the housing and a front end of the backrest bracket, and the stop includes a plurality of steps of varying thicknesses. In addition, a lever is supported on the housing for engaging the travel stop and shifting it between a plurality of positions in which different ones of the steps are interposed between the housing and the front end of the backrest bracket to limit the travel of the brackets toward the upright position. As a result, it is possible for a user to adjust the forward most position of the chair from a seated position, facilitating operation of the control mechanism.

Another aspect of the invention is to provide a tilt control assembly for locking and unlocking the seat and backrest for tilting movement. The assembly includes a locking plate supported on the housing for relative translational movement between an extended position in which the locking plate is received in the at least one aperture of the backrest bracket to lock the backrest bracket from further pivotal movement, and a retracted position removed from the aperture to allow further pivotal movement of the backrest bracket, wherein retraction of the locking plate from the at least one aperture is resisted by a friction force when the pivoting force of the spring assembly is exerted on the locking plate through the backrest bracket. An actuating lever is supported on the housing for pivotal movement about a horizontally extending pivot axis, and a locking pawl engages the locking plate and is supported on the actuating lever for relative rotation between a first position in which the pawl extends the locking plate and a second position in which the pawl retracts the locking plate.

In order to prevent inadvertent unlocking of the seat and backrest when the user is not seated, a clutch is interposed between the actuating lever and the locking pawl for exerting a rotating force on the locking pawl to move the locking pawl from the second position when the actuating lever is rotated. The rotating force is smaller than the friction force that is exerted on the locking plate when the pivoting force of the spring assembly is exerted on the locking plate such that the locking plate can only be retracted when the friction force is reduced to a magnitude less than the rotating force.

BRIEF DESCRIPTION OF THE SEVERAL VIEWS OF THE DRAWING

The preferred embodiment of the present invention is described in detail below with reference to the attached drawing, wherein.

DETAILED DESCRIPTION OF THE INVENTION

Figure 1:
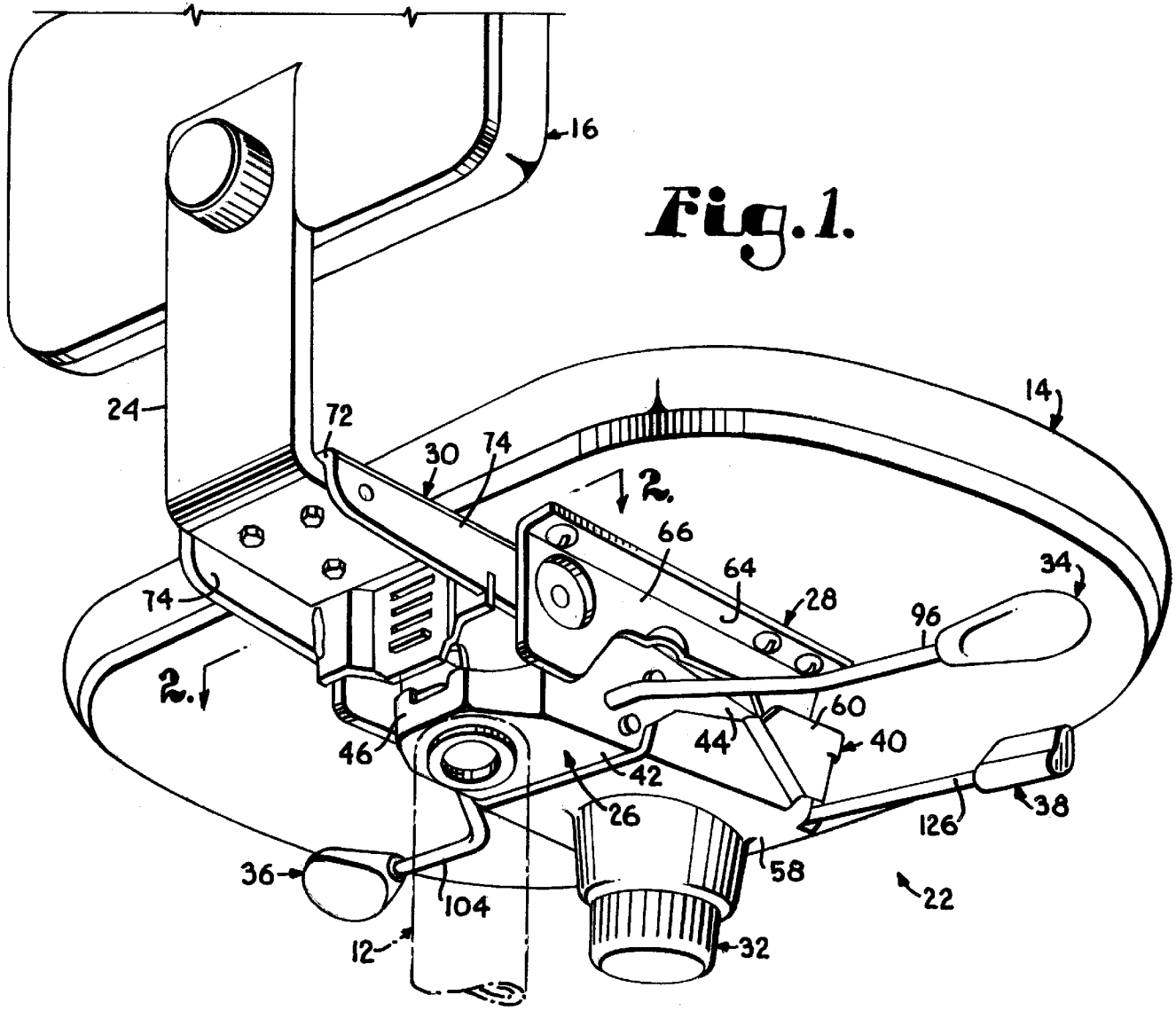
FIG. 1 is a perspective view of a chair control mechanism constructed in accordance with the preferred embodiment of the present invention, illustrating the mechanism assembled on a chair.
Figure 3:
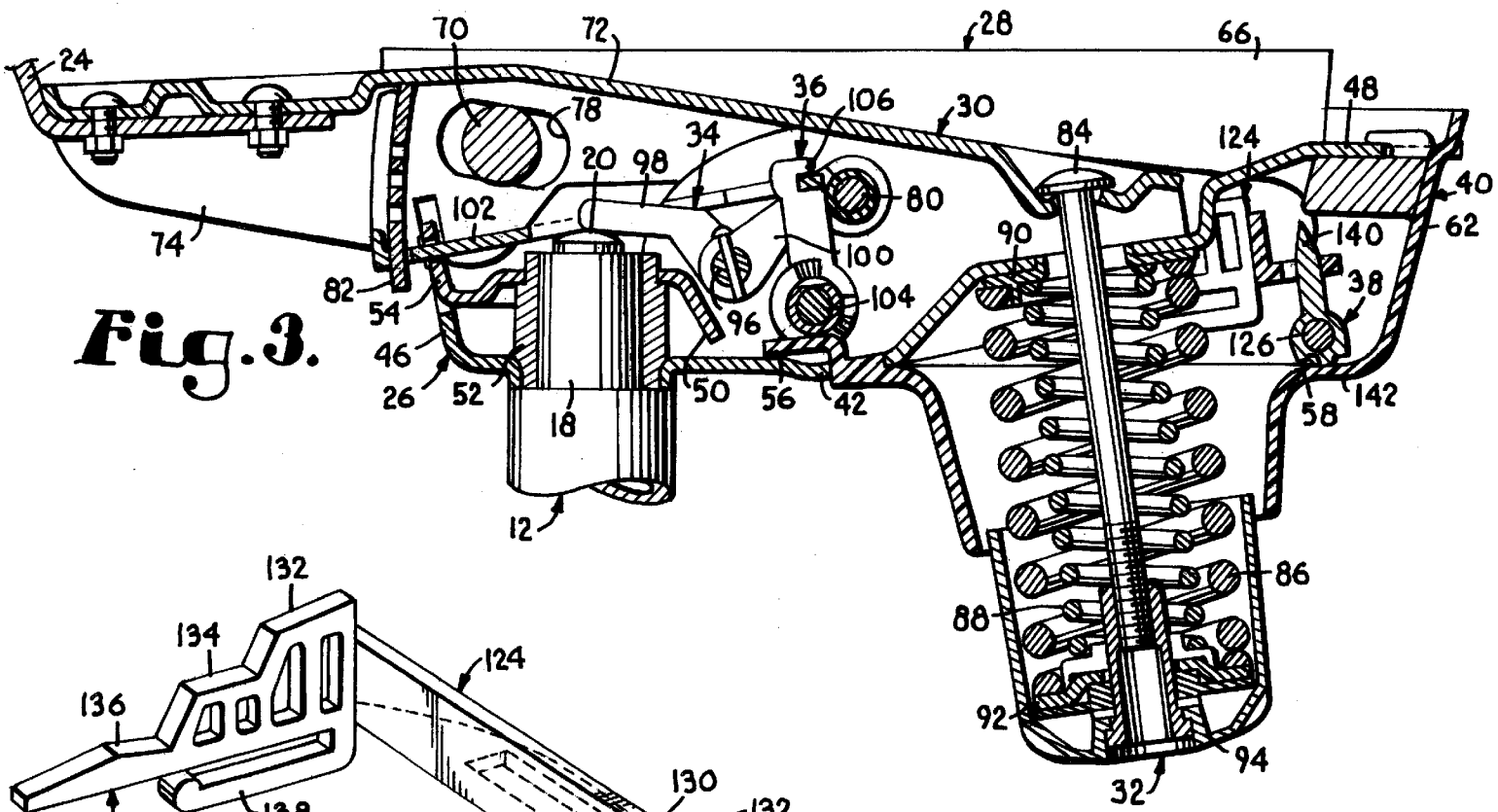
FIG. 3 is a sectional view taken along line 3—3 of FIG. 2.

A chair control mechanism constructed in accordance with the preferred embodiment of the present invention is shown in FIG. 1, assembled on a conventional chair having a base 12, a seat 14, and a backrest 16. The base includes a plurality of legs with casters for supporting the chair on the floor, and an upstanding spindle that supports a conventional gas cylinder 18, as shown in FIG. 3, for permitting the height of the seat to be adjusted. The gas cylinder presents an upper end on which a button 20 is disposed for actuating the cylinder for longitudinal adjustment. When the button is depressed, the cylinder is biased toward a raised or extended position but can be lowered against the biasing force of the cylinder. When the button is released, air is trapped in the cylinder, locking it against either raising or lowering movement.

Returning to FIG. 1, the seat 14 is connected to the base 12 through the control mechanism 22 and includes a rigid seat bottom and an upper cushion shaped to support a user in a seated position. The backrest 16 is connected to an extension bar 24 which, in turn, is connected to the base through the control mechanism 22. The backrest includes a rigid backing and a front cushion shaped to support the back of the user.

The chair control mechanism 22 generally includes a housing 26 supported on the base, a seat bracket 28 secured to the seat and supported on the housing, a backrest bracket 30 secured to the backrest and supported on the housing, and a spring assembly 32 connected between the housing and the seat and backrest brackets for biasing the seat and backrest toward an upright position. In addition, the mechanism includes a height control assembly 34 for actuating the gas cylinder to permit the height of the seat to be adjusted, a tilt control assembly 36 for locking and unlocking the seat and backrest for tilting movement, and a forward travel-stop control assembly 38 for permitting the forward tilted position of the seat and backrest to be adjusted.

The housing 26 includes a unitary body formed of metal, and a front cover 40 that is preferably formed of a suitable synthetic resin material. The body is generally channel shaped, presenting a bottom wall 42, a pair of laterally spaced upstanding side walls 44, and a rear wall 46 having a height slightly less than the height of the side walls. In addition, as shown in FIG. 3, the front end of the bottom wall includes a raised portion 48 adapted to support the spring assembly, and an extension that is bent upward and forward from the raised portion to present a pair of tabs used to support the cover.

With continued reference to FIG. 3, the bottom wall 42 of the housing body includes a first opening for receiving the spindle, the opening being located adjacent the rear end of the housing. A gusset plate 50 is welded or otherwise fixed to the rear and side walls of the housing body so as to present a top wall that extends in a plane generally parallel to the plane of the bottom wall of the body. The top wall includes an opening coaxial with the first opening, and is bent downward at the front end thereof to add rigidity to the housing. A metal tube 52 is secured to the plate and body within the openings, and is sized for receipt of the gas cylinder 18 to position the button 20 of the gas cylinder within the opening of the plate 50.

The gusset plate includes a rear projection 54 that is bent upward into a generally vertical orientation. The projection includes an elongated aperture that extends horizontally across the projection. As described below, this aperture supports a component of the tilt control assembly.

The housing body includes a second opening at the base of the raised portion 48, that is adapted to receive a tab 56 that extends from a rear portion of the cover for mounting the rear portion of the cover to the housing. In the mounted position, the tab 56 of the cover rests on the bottom wall. Once mounted, a rear wall of the projection abuts the opening to prevent inadvertent removal of the cover from the housing.

Figure 2:
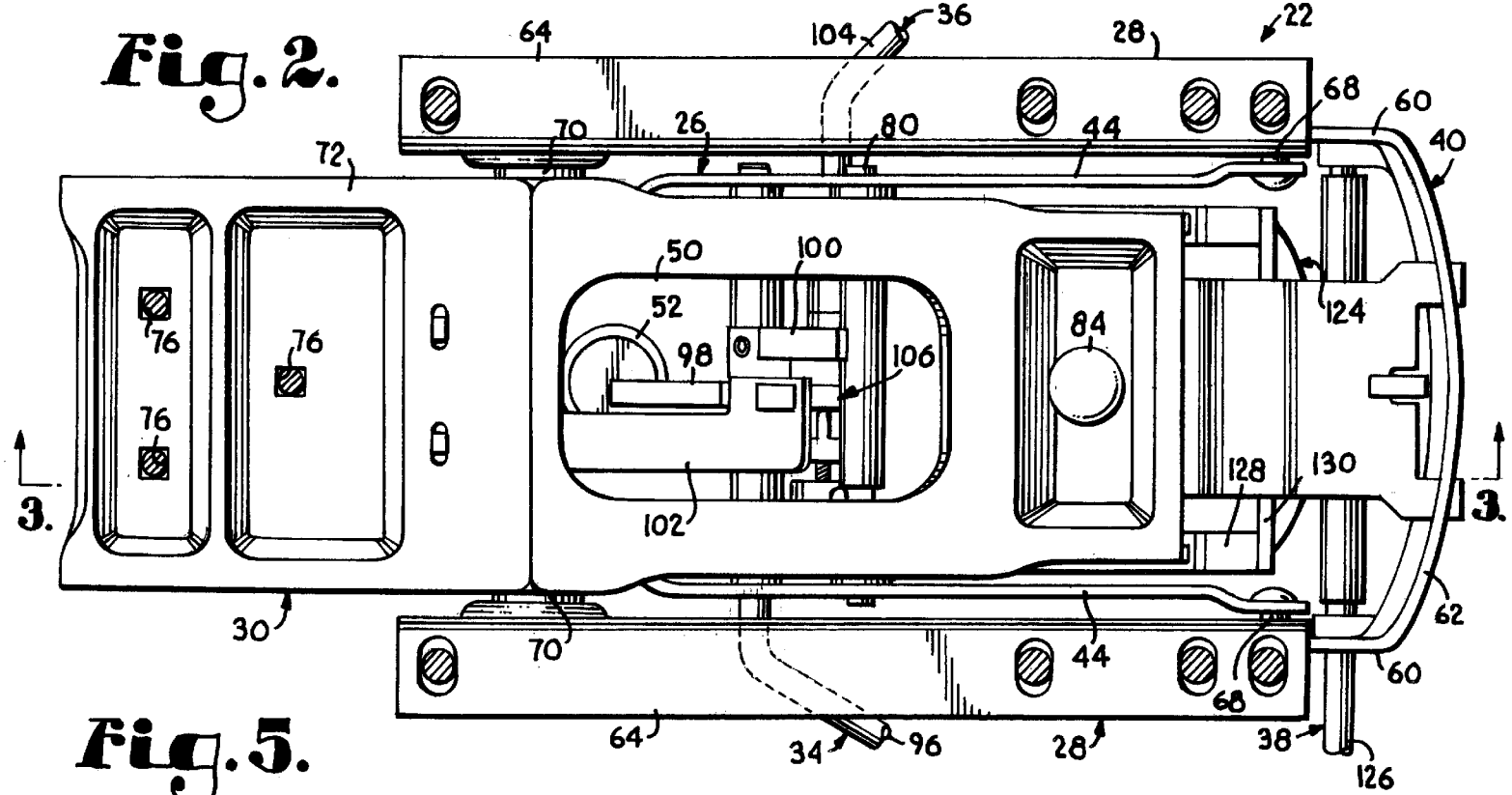
FIG. 2 is a sectional view taken along line 2—2 of FIG. 1.

As shown in FIG. 1, the cover includes a bottom wall 58, a pair of laterally spaced side walls 60 and a front wall 62, shown in FIG. 2. As is visible in FIG. 1, the bottom wall includes a large hole through which the spring assembly 32 extends to permit adjustment of the biasing force exerted on the seat and backrest. The side walls 60 are spaced from one another by a distance greater than the distance of spacing of the side walls of the housing body so that the cover is received over the body. A pair of coaxial holes are formed in the side walls adjacent the front bottom corner of the cover for supporting one of the components of the forward travel-stop control assembly 38. The cover 40 is mounted to the front of the housing to shroud the housing and to prevent the intrusion of objects between the chair seat and the housing as the chair pivots relative to the housing.

Figure 6:
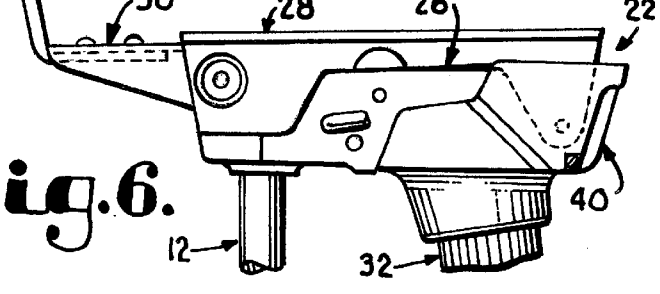
FIG. 6 is a side elevational view of the mechanism in a forward tilted orientation.

The seat bracket 28 is preferably defined by a pair of laterally spaced metal rails that are each independently secured to the seat and supported on the housing for pivotal movement. Each rail includes a top wall 64 and a depending side wall 66. As shown in FIG. 2, the top wall 64 of each rail includes a plurality of holes through which threaded fasteners can be inserted to secure the rail to the seat. With reference to FIG. 6, the depending side wall 66 of each rail includes a depending tongue at the front end thereof within which a hole is formed for receiving a pin 68 used to attach the rail to the housing for relative pivotal movement. As shown in FIG. 2, each rail also includes a second hole formed adjacent the rear end of the side wall 66 for receiving a pin 70 used to link the rail to the backrest bracket 30. Preferably, a bearing, e.g. of nylon or the like, is received in the front hole of each side wall, and includes a hollow stud that is received in the hole and a flange that fits between the side wall of the rail and the housing body. Each pin 68 is defined by a stepped rivet that extends through the bearing stud and the hole in the rail to pivotally secure the rails on the housing for rotation about the axis of the rivet. As such, the rivets of the rails, which are colinear, define a front pivot axis.

Figure 5:
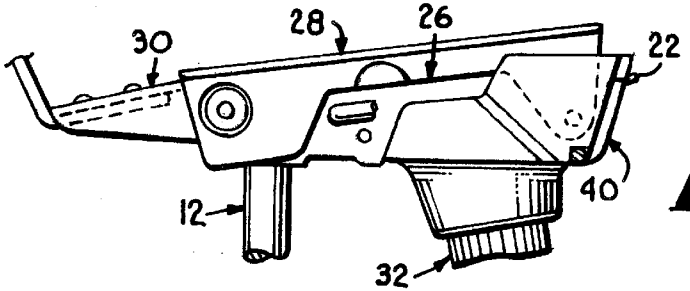
FIG. 5 is a side elevational view of the mechanism in a rearward tilted orientation.

By providing the tongues at the lower front ends of the rails 28, the front pivot axis is positioned as low and as far forward as possible on the mechanism. As such, when the seat is tilted toward the reclined position shown in FIG. 5, the front edge of the seat does not tip upward nearly as much as is the case with many conventional mechanisms. This "knee pivot" action reduces the lifting pressure applied under the knees of the user which otherwise would tend to lift the user's feet off the ground in the reclined position of the seat. As such, an ergonomic construction results.

As shown in FIG. 1, the backrest bracket 30 is generally channel shaped, including a top wall 72 and a pair of depending side walls 74. The top wall 72 is shown in FIG. 3, and is bent along a horizontal line located just to the rear of the center of the bracket. A hole is provided through the top plate at the front end thereof for receiving a component of the spring assembly 32, and the top plate is bent downward on the front and back sides of the hole to strengthen the plate around the hole and to provide room above the hole for relative movement between the spring assembly component and the bracket. In addition, as shown in FIG. 2, a plurality of holes 76 are formed in the top wall at positions rearward of the bend for permitting attachment of the bracket 30 to a lower end of the extension bar 24.

Figure 7:
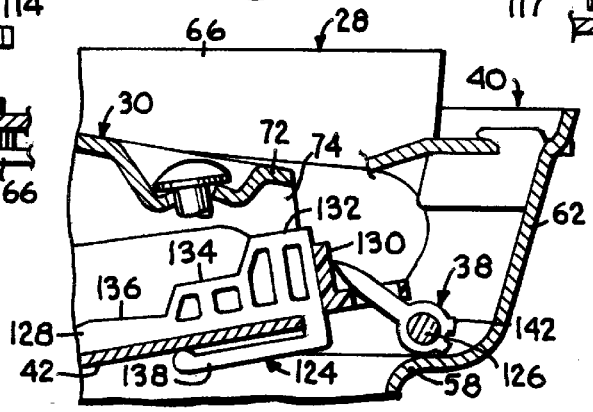
FIG. 7 is a fragmentary sectional view of the mechanism, illustrating a forward travel-stop control assembly forming a part thereof.

As shown in FIG. 3, the side walls 74 of the backrest bracket each present a shoulder at the front end of the bracket for engaging the forward travel-stop control assembly 38, shown in FIG. 7, a front hole located about one-third of the way back toward the rear end of the side wall through which the backrest bracket is supported for pivotal movement relative to the housing 26, and a rear slot 78 located about two-thirds of the way back toward the rear end of the side wall through which a link is provided between the backrest and seat brackets. As shown in FIG. 2, the front holes in the side walls are sized for receipt of a pivot pin 80 that extends completely through the housing body and the backrest bracket. A bearing, e.g. of nylon or the like, is received in the hole of each side wall, and includes a hollow stud that is received in the hole and a flange that fits between the side wall of the backrest bracket and the housing body. The pin 80 extends through the bearing studs and through holes in the housing to support the backrest bracket for pivotal movement about the rear pivot axis defined by the pin. The axial ends of the pin 80 are deformed upon assembly to fix the pin on the housing.

As shown in FIG. 3, the rear slots 78 in the side walls 74 of the backrest bracket 30 extend in a direction generally radial to the rear pivot axis defined by the pin 80, and are sized for receipt of the pins 70 used to link the rails 28 to the backrest bracket 30. Preferably, a bearing, e.g. of nylon or the like, is received in each slot, and includes a hollow stud that is received in the slot and a flange that fits between the side wall of the backrest bracket and the side wall of one of the rails. The pins 70 are each defined by a stepped rivet that extends through the bearing stud and the hole in the rail to secure the backrest bracket to the rails for both sliding movement of the rivets within the slots 78, and for rotation about the axes of the rivets. As such, the rails and backrest bracket are linked together, and movement of one is transmitted to the other to synchronize tilting of the seat and backrest.

A metal plate 82 extends between and is secured to the side walls 74 of the backrest bracket 30, and includes a plurality of vertically spaced, horizontally extending apertures sized for receipt of a component of the tilt control assembly 36. Preferably, the plate 82 is slightly arcuate, being curved about the rear pivot axis defined by the pin 80. As such, the radial distances between the lockout plate and the apertures is the same for all apertures.

The construction of the control mechanism as described herein provides several advantages over conventional chair tilt mechanisms. For example, the problems associated with uneven seat and backrest movement of the prior art during chair tilt, such as bridging, crunching, pushing and falling away, are minimized. In addition, the preferred mechanism of the invention can be produced from components which are formed by conventional metal stamping and welding operations.

In any chair having synchronized seat and backrest movement, the change in relative position of the backrest during tilting can cause a loss of lumbar support. Thereafter, if the user shifts his or her position in the tilted chair, pressure is exerted against the user's lower back when the seat and backrest are brought upright. This is caused by the chair back tilting away from the seat during reclining movement, and then back in toward the seat when it is tilted forward. A typical chair control mechanism for providing synchronized movement of the seat and backrest has three main members pivotally attached to each other. In addition, one pivot joint needs to allow sliding motion between the two members. This sliding motion duplicates the action of an imaginary "fourth link," providing a four-bar linkage motion.

The present invention minimizes shifting of the backrest relative to the seat to provide the most ergonomic construction possible. Specifically, the pivot axis of the seat bracket and the pivot axis of the backrest bracket are disposed in substantially the same plane as the axis defined by the pins of the linkage such that the amount of sliding movement between the backrest and the seat during tilting is optimized. As such, the front-to-rear motion between the two chair parts is biased to produce movement of the seat toward the back during rear tilting.

The spring assembly 32 is shown in FIG. 3, and includes a support bolt 84, a pair of concentric compression springs 86, 88 received over the bolt, and a pair of spring seats 90, 92 that limit the extension of the springs. The support bolt 84 includes a head at one end and is threaded at the other end. In addition, a portion of the length of the bolt adjacent the head includes a square cross-sectional shape corresponding to the square shape of the hole in the top wall 72 of the backrest bracket 30 so that the bolt is secured against rotation relative to the backrest bracket during adjustment of the spring assembly.

Although two compression springs are shown in the drawing, any number of springs can be employed as appropriate to provide the desired biasing force on the backrest bracket to bias the seat and backrest toward the upright position. Each spring 86, 88 presents opposed axial ends that are received by the seats 90, 92. The seat 90 is secured to the underside of the bottom wall of the housing, and the other seat 92 is supported on a hand-actuated knob 94 that is received on the threaded end of the bolt 84. During operation of the spring assembly, the biasing force exerted on the backrest bracket is adjusted by turning the knob 94 so that the spring seat 92 supported on the knob is shifted axially along the bolt 84 to further compress or extend the springs 86, 88. The knob is accessible through the bottom hole in the cover 40 so that a user can access the knob from the seat, facilitating use of the assembly.

The height control assembly 34 is illustrated in FIG. 1, and includes a lever 96 that is supported for rotation within a pair of holes in the side walls of the housing. The lever 96 is generally Z-shaped, presenting an inner section supported between the side walls of the housing, an outer section having a handle by which the lever can be manipulated, and an angled intermediate section connecting the end sections together. The inner and outer end sections of the lever 96 are generally parallel to but offset from one another so that when the handle is lifted and lowered, the inner section rotates within the holes of the housing.

As shown in FIG. 3, a pawl is secured to the inner section of the lever, and presents a first radially extending arm 98 that engages the button 20 of the gas cylinder 18 when the lever is rotated in a first direction, and a second radially extending arm 100 that engages the pivot pin 80 to limit rotation of the lever 96 in the opposite direction. As such, lifting of the handle causes the first arm 98 to engage the gas cylinder to permit adjustment in the height of the seat, and when the lever is released, gravity moves the lever to a lowered position.

Figure 8:
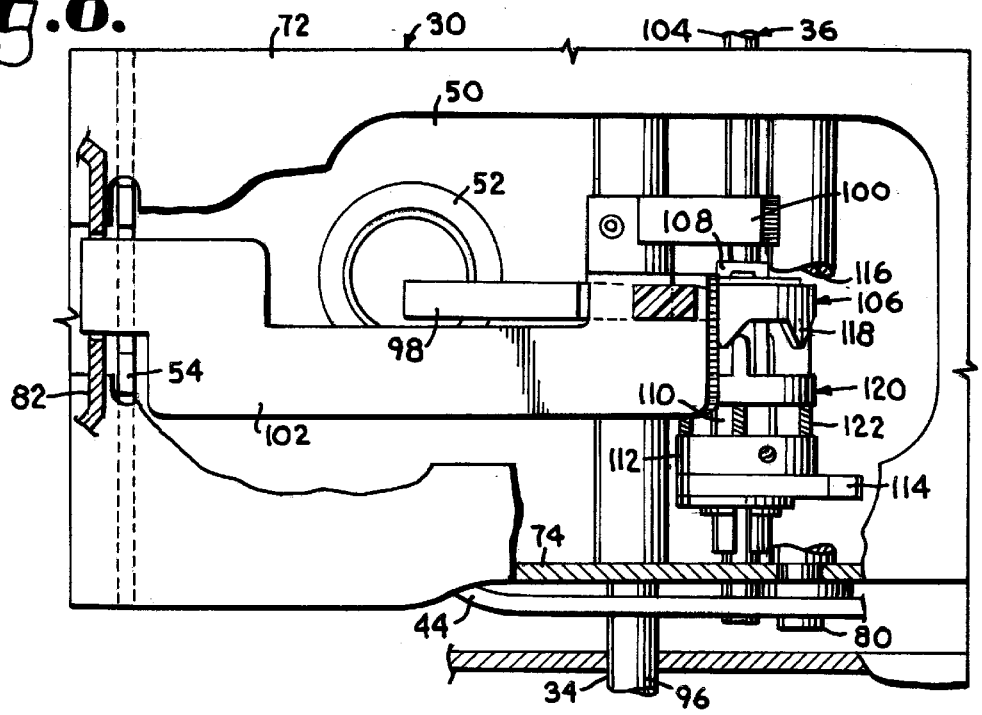
FIG. 8 is a fragmentary sectional view similar to FIG. 2, illustrating a tilt control assembly forming a part of the mechanism.

The tilt control assembly 36 is illustrated in FIG. 8, and broadly includes a lock plate 102 supported on the housing for longitudinal translational movement, a lever 104 supported on the housing for rotation within a pair of holes in the housing side walls 44, a pawl 106 supported on the lever 104 for relative rotation, and a clutch that transmits rotational movement of the lever to the pawl.

The lock plate 102 is formed of a flat piece of metal, and includes longitudinally opposed inner and outer ends. A hole is formed in the plate adjacent the inner end, and is sized for receipt of the pawl 106. The second end of the plate is sized for receipt in the aperture of the rear projection 54 of the housing 26 as well as in the apertures of the backrest bracket plate 82. A shoulder is formed in the lock plate adjacent the outer end for limiting rearward translational movement of the lock plate, and a cutout region is provided for accommodating the first arm 98 of the height control assembly. The lock plate 102 is movable between a retracted position, as illustrated in FIG. 3, in which the rear outer end is removed from the apertures of the backrest bracket plate 82, and an extended position, as shown in FIG. 8, in which the rear end of the lock plate is received in the apertures. At all times, the rear end of the lock plate is supported on the housing by the rear projection 54. Resilient bumpers are preferably mounted on the upper end of the rear projection 54 to cushion contact between the housing and the backrest bracket.

Returning again to FIG. 1, the lever 104 is generally Z-shaped, presenting an inner section supported between the side walls of the housing, an outer section having a handle by which the lever can be manipulated, and an angled intermediate section connecting the end sections together. The inner and outer end sections are generally parallel to but offset from one another so that when the handle is lifted and lowered, the inner section rotates within the holes of the housing.

Figure 10:
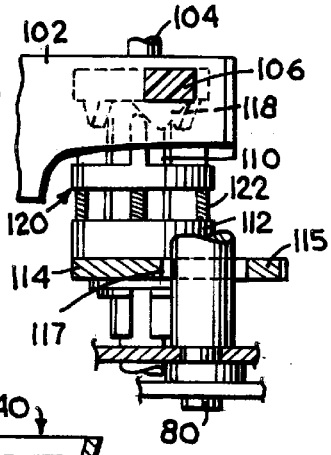
FIG. 10 is a fragmentary view similar to FIG. 9, illustrating the components of the tilt control assembly in an unlocked position.

As illustrated in FIG. 8, a collar is secured to the inner section of the lever for rotation therewith, and includes four axially spaced portions 108, 110, 112, 114. The portion 108 of the collar adjacent a first end thereof presents a cylindrical circumferential surface on which the pawl 106 is supported. A spring clip 116 or other conventional type of retainer is used to hold the pawl in place on the first collar portion 108 while allowing relative rotation between the pawl 106 and the lever 104. The second portion 110 of the collar also includes a cylindrical circumferential surface, but is provided with axially extending splines that function with annular ring 120. The third portion 112 of the collar is of a diameter greater than the second portion, presenting a shoulder within which a plurality of spring seats are formed. The fourth portion 114 of the collar is disposed adjacent the second end thereof, and includes a pair of radially extending arms 115, 117 that are circumferentially spaced from one another by a distance equal to the desired angular range of motion of the lever. The arms extend beyond the pin 80 on either side thereof, as shown in FIG. 10, and engage the pin 80 to limit lever travel in both directions.

Figure 9:
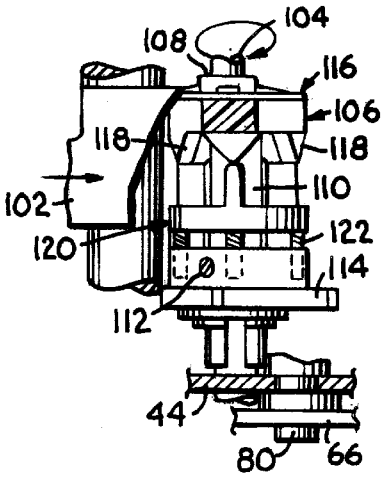
FIG. 9 is a fragmentary view of the tilt control assembly, illustrating the movement of the components thereof from a locked position.

As shown in FIG. 3, the pawl 106 includes an annular base that is received on the collar, and a radially extending arm that is received in the hole of the lock plate 102. The base includes an inner end wall presenting a cam surface, as shown in FIG. 9, and the cam surface includes a plurality of generally triangular bumps 118 protruding therefrom.

The clutch is defined by an annular ring 120 that is supported on the splined portion 110 of the collar so that it rotates with the collar but is free for axial movement relative to the collar. A plurality of compression springs 122 are interposed between the ring and the seats defined by the third collar portion 112. The ring 120 includes an outer end wall that faces the inner end wall of the pawl 106, and includes a plurality of axially extending fingers that engage the cam surface of the pawl to rotate the pawl under certain circumstances, shifting the lock plate 102 between its retracted and extended positions.

When the lock plate 102 is in its retracted position, as illustrated in FIG. 3, the rear end of the plate is withdrawn from the apertures of the backrest bracket plate 82, allowing free tilting movement of the seat and backrest. In order to lock the seat and backrest against further tilting movement, the handle of the lever 104 is lowered, rotating the collar and ring 120, as shown in FIG. 9, such that the fingers on the ring ride up the backsides of the bumps 118 of the pawl 106 and over the tops thereof. The force of the fingers against the bumps, as in the position shown in FIG. 8, biases the pawl 106 toward a rearward pivoted position with sufficient force to rotate it. This rotation of the pawl shifts the lock plate 102 rearwardly toward the extended position. If the rear end of the lock plate is not aligned with one of the apertures in the backrest bracket plate 82, the force of the fingers against the bumps is maintained until the seat is further tilted to align one of the apertures with the lock plate. Once such alignment is achieved, the plate 102 is shifted into the extended position protruding into the aligned aperture. As such, the backrest bracket 30, and thus the seat bracket 28, are locked against further tilting in either direction.

In order to subsequently unlock the seat and backrest for tilting movement, the handle of the lever 104 is lifted, rotating the collar and ring 120 such that the fingers on the ring ride up the front sides of the bumps 118 and over the tops thereof. The force of the fingers against the back sides of the bumps, as shown in FIG. 10, biases the pawl 106 toward a forward pivoted position with sufficient force to normally rotate the pawl. This rotation of the pawl shifts the lock plate 102 forwardly toward the retracted position. If the rear end of the lock plate is pinched by the backrest bracket 30, e.g. because the seat is unoccupied and the biasing force of the spring assembly 32 is being transmitted to the lock plate through the backrest bracket, the force of the fingers against the bumps 118 is maintained until the back is loaded and the forward biasing force of the spring assembly is reduced or overcome by a counter force sufficient to free the lock plate 102 from the grip of the backrest bracket. Once such unloading of the lock plate is achieved, the plate is shifted to the retracted position. As such, the backrest bracket 30, and thus the seat bracket 28, are unlocked for further tilting in either direction.

It is understood that although the lock plate 102 has been described as being pinched by the backrest bracket due to the forward biasing force of the spring assembly 32 when no one is sitting in the chair, any unbalanced force on the backrest bracket that exerts a pinching friction force on the lock plate will prevent unlocking of the plate if the friction force is greater than the rotating force exerted on the lock plate by the pawl 106 and the ring 120. As such, the assembly prevents the seat and backrest from being thrown from a locked orientation when no one is sitting in the chair and the lever is lifted, and the chair can only be unlocked when the user is sitting in the chair applying a minimal force against the backrest.

Figure 4:
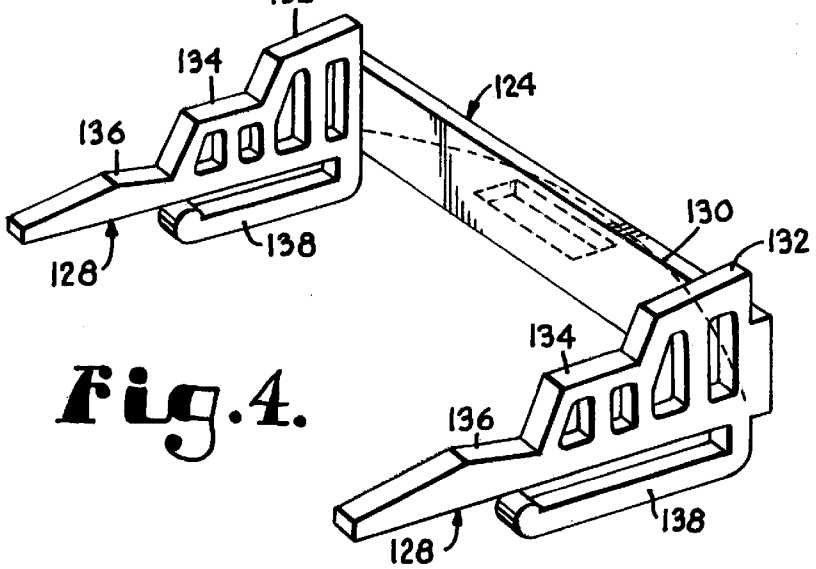
FIG. 4 is a perspective view of a travel stop forming a part of the mechanism.

The forward travel-stop control assembly 38 is shown in FIG. 7, and includes a travel stop 124 positioned between the bottom wall of the housing and the front end of the backrest bracket, and a lever 126 for shifting the travel stop longitudinally of the mechanism between a plurality of different positions. As illustrated in FIG. 4, the travel stop includes a pair of laterally spaced legs 128 aligned with the shoulders of the backrest bracket side walls, and a cross piece 130 connecting the legs together and presenting a central aperture. The legs present a plurality of steps 132, 134, 136 of varying thickness, with the rearward or distal steps 136 being the thinnest and the forward or proximal steps 132 being the thickest. Although the travel stop is illustrated as including three progressively thicker steps on each leg, any number of such steps can be employed.

A mounting finger 138 extends along a lower portion of each leg 128 of the travel stop to form an open slot for slidably mounting the tilt adjustment assembly to a mounting flange on the lower wall of the housing, as shown in FIG. 7. A lip extends upward from the finger to provide some frictional resistance to sliding.

Returning to FIG. 7, the lever 126 is supported for rotation on the cover 40 within the holes formed in the cover side walls, and includes a radially extending pawl 140 that is fixed to the lever 126 for rotation therewith and is received in the aperture of the cross piece 130 so that rotation of the lever shifts the travel stop 124 longitudinally back and forth along the bottom wall of the housing. The pawl 140 includes a collar encompassing the lever, and the collar includes a plurality of detents 142 on the bottom side thereof that engage the cover to hold the lever in each rotational position to which it is moved. The natural resiliency of the cover which is integrally molded of a suitable synthetic resin material biases the inward projection against the indentations on the arm. In addition, a plug of synthetic resin material or the like can be fitted to the inside of the cover 40 beneath the raised portion 48 of the housing to limit upward movement of the stop 124 that would otherwise permit the crosspiece 130 to lift off of the pawl.

The travel stop 124 is shifted longitudinally fore and aft when the lever 126 is rotated relative to the cover such that one of the pairs of steps of the stop are aligned with the shoulders of the backrest bracket 30. The backrest bracket has a maximum forward tilt with the thinnest or smallest steps 136 interposed between the housing and the backrest bracket. If the maximum forward tilt is not desired by a user, the user leans back on the chair to disengage the backrest bracket from the steps, and the lever is rotated to slide the tilt adjustment assembly rearward until one of the other pairs of steps 132 134 are in alignment with the shoulders. The chair will then have a more rearward rest position.

Although the invention has been described with reference to the preferred embodiment illustrated in the attached drawing figures, it is noted that substitutions may be made and equivalents employed herein without departing from the scope of the invention as recited in the claims.

We claim:

1. A chair control mechanism for use on a chair having a base on which a seat and backrest are supported, the seat presenting a front which is opposite the backrest, the mechanism comprising:

a housing supported on the base;

a seat bracket supported on the housing for pivotal movement about a horizontally extending front pivot axis between an upright position and a reclining position;

a backrest bracket supported on the housing for pivotal movement about a horizontally extending rear pivot axis between an upright position and a reclining position, the backrest bracket being linked to the seat bracket and presenting a front end forward of said rear pivot axis that moves toward the housing when the brackets are pivoted toward the upright position and away from the housing when the brackets are pivoted toward the reclining position, said front end having a downwardly extending shoulder;

a spring assembly connected to the housing and the backrest bracket and biasing the brackets toward the upright position;

a travel stop positioned on a lower surface of said housing between the housing and the front end of the backrest bracket, the stop including a plurality of steps of varying heights;

a lever connected to said housing and having a rotational axis; and a pawl operatively connected to and extending radially from the lever and engaging the travel stop, the lever being movable to shift the stop in fore and aft directions between a plurality of positions in which different ones of the steps are interposed between the lower surface of said housing and the shoulder of the front end of the backrest bracket to limit the travel of the brackets toward the upright position.

2. A mechanism as recited in claim 1, wherein the lever is rotatable to shift the stop between the plurality of positions, the lever being supported on the housing.

3. A mechanism as recited in claim 1, wherein the backrest bracket includes a pair of laterally spaced side walls each presenting a depending said shoulder at the front end of the backrest bracket, and the travel stop includes a pair of laterally spaced legs aligned with the shoulders and interposed between the shoulders and the housing, and a cross piece connecting the legs together, the legs presenting the plurality of steps of varying heights, and the cross piece presenting an aperture within which the pawl of the lever is received.

* * * * *